US009325082B2

(12) United States Patent
Furukawa

(10) Patent No.: US 9,325,082 B2
(45) Date of Patent: Apr. 26, 2016

(54) CRIMPED TERMINAL FOR COAXIAL CABLE

(75) Inventor: Shouichi Furukawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/001,564

(22) PCT Filed: Apr. 6, 2012

(86) PCT No.: PCT/JP2012/060096

§ 371 (c)(1),
(2), (4) Date: Aug. 26, 2013

(87) PCT Pub. No.: WO2012/137989

PCT Pub. Date: Oct. 11, 2012

(65) Prior Publication Data

US 2014/0000954 A1 Jan. 2, 2014

(30) Foreign Application Priority Data

Apr. 6, 2011 (JP) ..... 2011-084595

(51) Int. Cl.
*H01R 9/05* (2006.01)
*H01R 4/18* (2006.01)
*H01R 13/646* (2011.01)

(52) U.S. Cl.
CPC ..... *H01R 4/18* (2013.01); *H01R 4/188* (2013.01); *H01R 9/0518* (2013.01); *H01R 13/646* (2013.01)

(58) Field of Classification Search
CPC ..... H01R 9/0518; H01R 43/048; H01R 4/18; H01R 4/183
USPC ..... 439/578, 585; 174/359, 74 R
See application file for complete search history.

(56) References Cited

U.S. PATENT DOCUMENTS 6,482,034 B2 * 11/2002 Ozaki ..... 439/585
8,052,466 B2 * 11/2011 Okamoto ..... 439/585

(Continued)

FOREIGN PATENT DOCUMENTS

| | | | |
|---|---|---|---|
| EP | 1 063 724 | A1 | 12/2000 |
| EP | 2 148 400 | A1 | 1/2010 |
| JP | 2008-287899 | A | 11/2008 |
| JP | 2010-49859 | A | 3/2010 |
| JP | 2010-61870 | A | 3/2010 |

OTHER PUBLICATIONS

International Search Report dated Jun. 26, 2012 issued in International Application No. PCT/JP2012/060096 (PCT/ISA/210).

(Continued)

*Primary Examiner* — Vanessa Girardi
(74) *Attorney, Agent, or Firm* — Sughrue Mion, PLLC

(57) ABSTRACT

A shield terminal includes a braided part crimping member. The shield terminal is connected to a coaxial cable including a core wire, an insulator covering an outer periphery of the core wire, a braided part covering an outer periphery of the insulator and an outer jacket covering an outer periphery of the braided part. The braided part crimping member is crimped with and encloses a braided part exposing portion which is formed by removing the outer jacket to expose the braided part. A wall part of the braided part crimping member which comes into direct contact with the braided part is formed with a round hole so that a part of the braided part enters the round hole in a state where the braided part crimping part is crimped with the braided part exposing portion.

5 Claims, 6 Drawing Sheets

(56) References Cited

U.S. PATENT DOCUMENTS

| | | | | |
|---|---|---|---|---|
| 8,758,054 | B2 * | 6/2014 | Miyawaki et al. | 439/585 |
| 2006/0089046 | A1 | 4/2006 | Annequin | |
| 2008/0124972 | A1 | 5/2008 | Kobayashi et al. | |
| 2010/0221949 | A1 | 9/2010 | Okamoto | |

OTHER PUBLICATIONS

Written Opinion dated Jun. 26, 2012 issued in International Application No. PCT/JP2012/060096 (PCT/ISA/237).

Notification of the Dissolution of Pretrial Examination dated Jun. 2, 2015, in counterpart Japanese Application No. 2011-084595.

Office Action dated Apr. 10, 2015 issued by the State Intellectual Property Office of P.R China in corresponding Application No. 201280017484.X.

Office Action dated Dec. 9, 2014 issued by the Japanese Patent Office in counterpart Japanese Patent Application No. 2011-084595.

Communication issued on Feb. 20, 2015 by the Japanese Patent Office in related application No. 2011084595.

* cited by examiner

CRIMPED TERMINAL FOR COAXIAL CABLE

TECHNICAL FIELD

The present invention is related to a shield terminal for a coaxial cable which has a braided part crimping member connected to a braided part of a coaxial cable by a crimping operation.

BACKGROUND ART

A coaxial cable used for transmitting a high frequency signal such as an antenna wire generally includes a core wire as a central conductor, an insulator as a dielectric body for covering an outer periphery of the core wire, a braided part as an outer conductor for covering an outer periphery of the dielectric body and an outer jacket (an insulating sheath) for covering an outer periphery of the braided part in order toward an outer side from the center. In the coaxial cable having such a structure, a coaxial connector is provided in a terminal part thereof to connect the coaxial cable to a device or a coaxial cable of a mate side. The coaxial connector has a shield terminal which electrically connects the braided part to the coaxial connector in grounded manner so as to shield an electric noise such as an electromagnetic wave or static electricity.

FIG. 6 shows an example of a terminal structure of a coaxial cable disclosed in PTL1.

A coaxial cable 20 includes a core wire 21, an insulator 22 for covering an outer periphery of the core wire 21, a braided part 23 for covering an outer periphery of the insulator 22 and an outer jacket 24 for covering an outer periphery of the braided part 23. In a cable terminal part, a core wire exposing part 21A formed by removing the outer jacket 24, the braided part 23 and the insulator 22 to expose the core wire 21, an insulator exposing part 22A formed by removing the outer jacket 24 and the braided part 23 to expose the insulator 22 and a braided part exposing portion 23A formed by removing the outer jacket 24 to expose the braided part 23 are formed in order from an end side.

Then, a central conductor 61 of a coaxial connector 60 is held to the core wire exposing part 21A. A braided part crimping member 66 of a shield terminal 63 of the coaxial connector 60 is configured to be crimped with the braided part exposing portion 23A. An outer jacket holding part 67 of the shield terminal 63 is held to the outer jacket 24. Between the central conductor 61 and the shield terminal 63 of the coaxial connector 60, an insulator 62 is arranged.

When the braided part crimping member 66 of the shield terminal 63 is crimped with the braided part exposing portion 23A of the coaxial cable 20, a pair of braided part holding pieces are bent inside to hold the braided part exposing portion 23A mounted on a bottom plate of the braided part crimping member 66 so as to enclose the braided part exposing portion 23A. In order to increase a fixing force of the braided part crimping member 66 to the braided part 23, a fastening force P during a crimping operation needs to be increased as shown in FIG. 7A.

However, when the fastening force P is increased during the crimping operation, as shown in FIG. 7B, since an inner part of the insulator 22 of the coaxial cable 20 is extremely pressed, a disconnection occasionally arises in the core wire 21. A part shown by S in FIG. 7B indicates a disconnected part.

In the shield terminal 63 disclosed in the PTL1, as shown in FIG. 6, a through hole 66*a* is provided in a bottom plate part of the braided part crimping member 66 so that a part of the braided part 23 enters the through hole 66*a* during a crimping operation. In such a way, the fixing force of the braided part crimping member 66 of the shield terminal 63 to the braided part 23 of the coaxial cable 20 may be expected to be increased. As a result, the increase of the fastening force P during the crimping operation may be possibly mitigated to prevent the disconnection of the core wire 21.

CITATION LIST

[Patent Literature]
[PTL1] JP-A-2010-49859

SUMMARY OF INVENTION

Technical Problem

Even when the through hole 66*a* is provided in the bottom plate part of the braided part crimping member 66, a part of the braided part 23 may not sufficiently enter the through hole 66*a* depending on a shape of the through hole 66*a* so that the through hole does not cause the fixing force to be increased.

It is therefore one advantageous aspect of the present invention to provide a shield terminal for a coaxial cable which can increase a fixing force of a braided part crimping member to a braided part without especially increasing a fastening force during a crimping operation.

Solution to Problem

According to one advantage of the invention, there is provided a shield terminal, configured to be connected to a coaxial cable including a core wire, an insulator covering an outer periphery of the core wire, a braided part covering an outer periphery of the insulator and an outer jacket covering an outer periphery of the braided part, the shield terminal comprising:

a braided part crimping member configured to be crimped with and enclose a braided part exposing portion which is formed by removing the outer jacket to expose the braided part, wherein a wall part of the braided part crimping member which comes into direct contact with the braided part is formed with a round hole so that a part of the braided part enters the round hole in a state where the braided part crimping part is crimped with the braided part exposing portion.

The shield terminal may be configured such that: the wall part is formed with a plurality of round holes so that parts of the braided part enters the round holes in the state where the braided part crimping member is crimped with the braided part exposing portion, and the round holes are arranged in a direction orthogonal to a longitudinal direction of the coaxial cable.

The shield terminal may be configured such that: the braided part crimping member includes a bottom plate on which the braided part is mounted and a pair of braided part holding pieces extending from both sides of the bottom plate in a direction of width, so as to have a U-shape in section; the bottom plate is formed with a round hole so that a part of the braided part enters into the round hole in the state where the braided part crimping part is crimped with the braided part exposing portion; one of the braided part holding pieces which is rounded inside and comes into direct contact with the braided part is formed with a round hole so that a part of the braided part enters into the round hole in the state where the braided part crimping part is crimped with the braided part exposing portion; the round hole of the bottom plate and the round hole of the one of the braided part holding pieces are arranged at positions so as to sandwich the braided part exposing portion therebetween in the state where the braided part crimping part is crimped with the braided part exposing portion; and a straight line connecting the round hole of the bottom plate and the round hole of the one of the braided part holding pieces is set so as to correspond to a direction that a fastening force is applied to the braided part exposing portion during crimping the braided part crimping member with the braided part exposing portion.

The round holes may be disposed at positions which oppose each other in the state where the braided part crimping part is crimped with the braided part exposing portion.

Advantageous Effects of Invention

According to the shield terminal of the present invention, since the round hole does not include a square part which generates a regulating operation when the braided part enters, the braided part enters the round hole uniformly in an entire circumference. Accordingly, the braided part can sufficiently enter the round hole. As a result, the fastening force is not especially increased during the crimping operation and a fixing force to the coaxial cable can be increased without a fear of disconnection of the core wire.

According to the shield terminal of the invention, since the round holes are located at positions to which a pressing force is most strongly applied during the crimping operation, the braided part assuredly enters the round holes. As a result, the fixing force of the shield terminal to the braided part can be increased.

According to the shield terminal of the invention, when the one round holes are merely provided respectively in the bottom plate or the braided part holding piece of the braided part crimping member, a diameter of the round hole needs to be enlarged in order to increase an effective edge length of the round hole. Here, the effective edge length of the round hole indicates a length of a peripheral edge part of the round hole which contributes to exhibit an effective resistance force when a tensile force is applied along the longitudinal direction of the coaxial cable. However, when the plurality of round holes are arranged in the direction orthogonal to the longitudinal direction of the coaxial cable, the effective edge length to the tensile force can be long ensured by decreasing the diameter of the round hole. Accordingly, the resistance force (the fixing force) strong to the tension can be exhibited.

According to the present invention, the fastening force during the crimping operation is not especially increased, there is no fear of disconnection of the core wire and the fixing force of the braided part crimping member to the braided part can be increased.

DESCRIPTION OF EMBODIMENTS

Figure 1A:
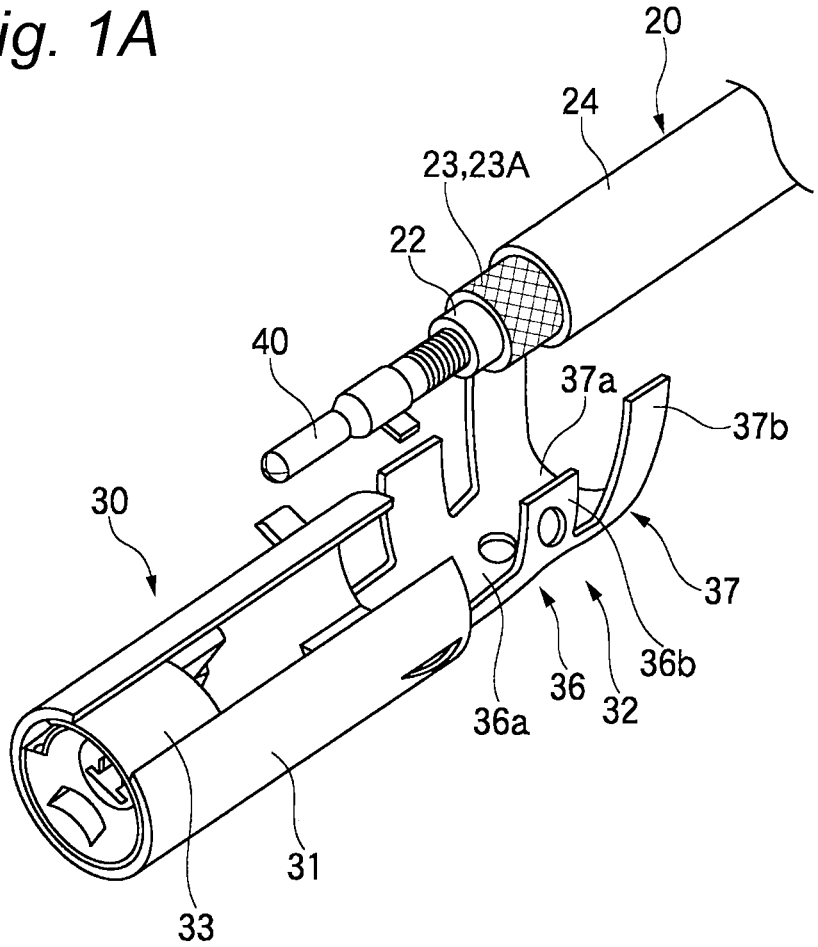
FIG. 1A is a perspective view showing a coaxial connector including a shield terminal according to an embodiment of the present invention and a coaxial cable.

Now, an embodiment of the present invention will be described below by referring to the drawings.

Figure 1B:
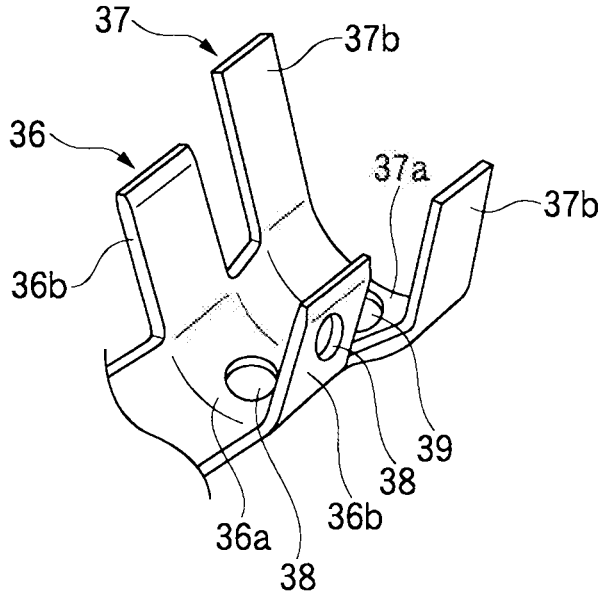
FIG. 1B is a perspective view showing a structure of a braided part crimping member and an outer jacket holding part of the shield terminal which are merely taken out.
Figure 1C:
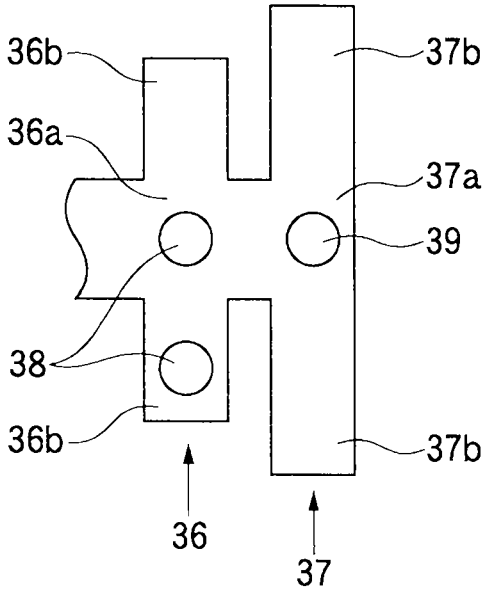
FIG. 1C is a development view of the braided part crimping member and the outer jacket holding part.
Figure 2:
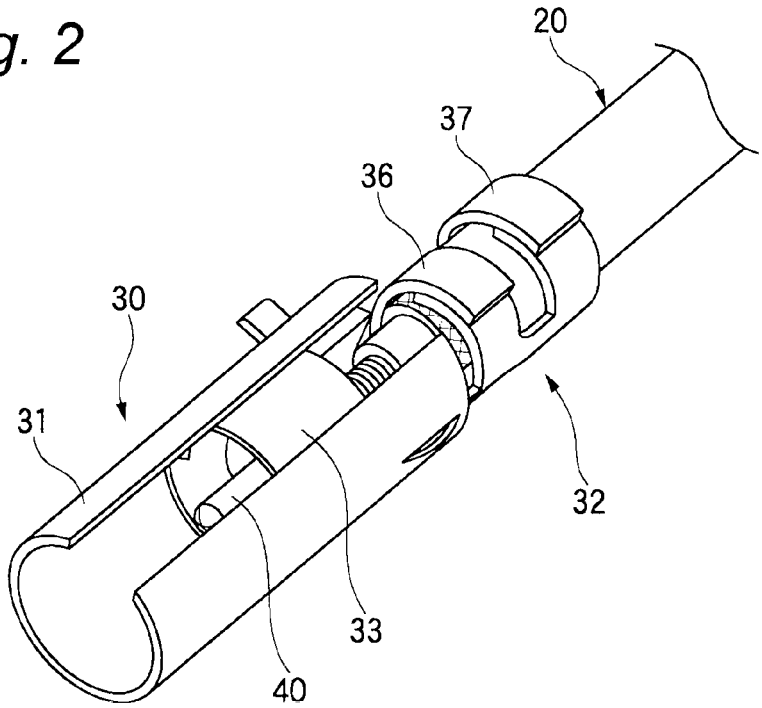
FIG. 2 is a perspective view showing a state that the coaxial connector is connected to the coaxial cable.
Figure 3A:
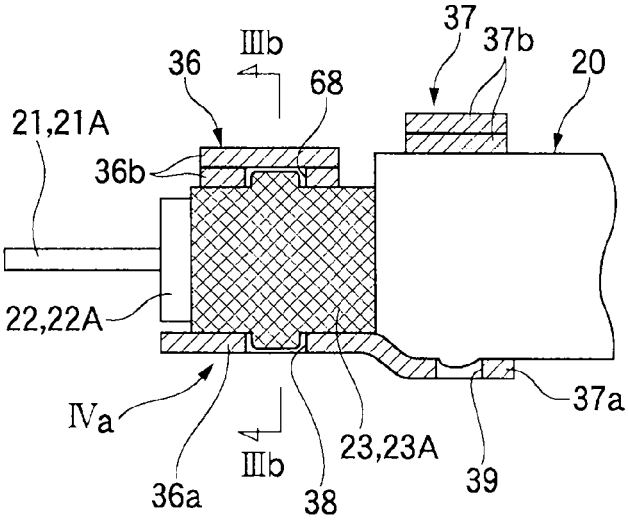
FIG. 3A is a longitudinally sectional view of a part in which a holding part of the shield terminal is fixed to a terminal part of the coaxial cable.
Figure 3B:
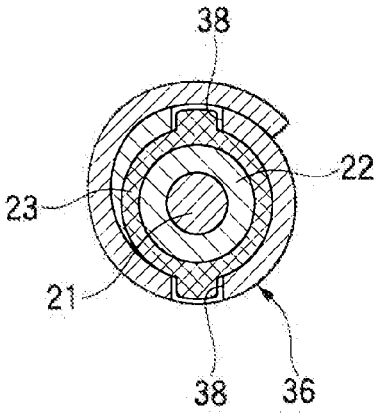
FIG. 3B is a sectional view taken along a line IIIb-IIIb of FIG. 3A.
Figure 4A:
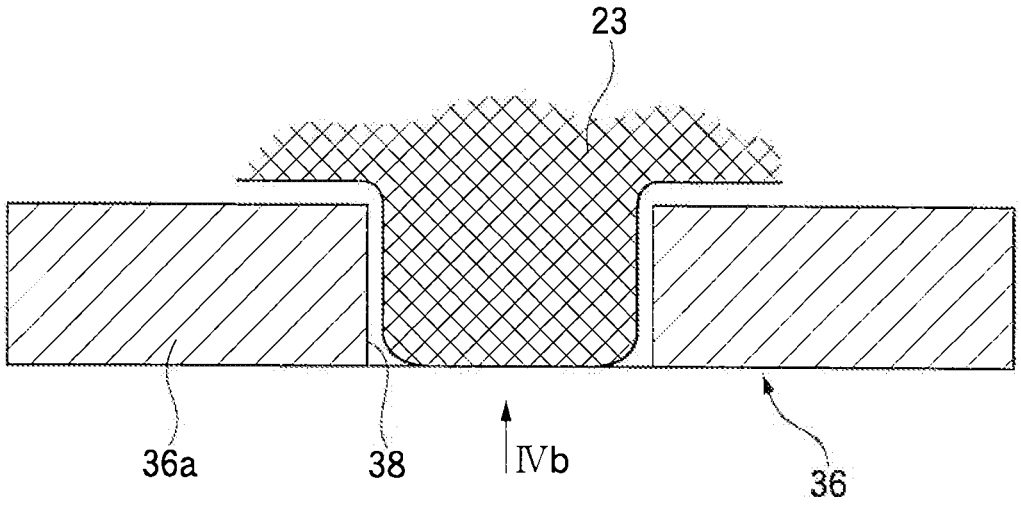
FIG. 4A is an enlarged view of a part shown by an arrow mark IVa in FIG. 3A.
Figure 4B:
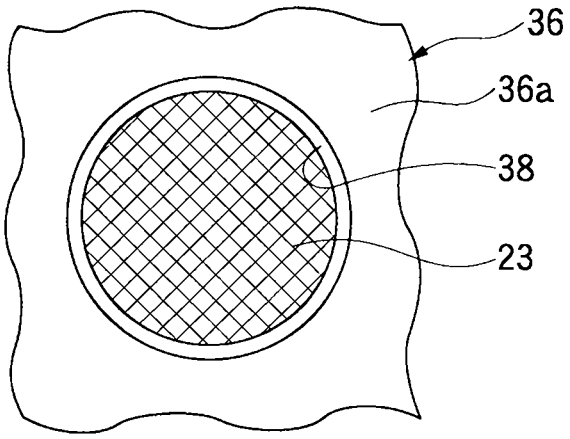
FIG. 4B is a view of a part shown by an arrow mark IVb in FIG. 4A.

FIG. 1A is a perspective view showing a coaxial connector including a shield terminal according to an embodiment of the present invention and a coaxial cable. FIG. 1B is a perspective view showing a structure of a braided part crimping member and an outer jacket holding part of the shield terminal which is merely taken out. FIG. 1C is a development view of the braided part crimping member and the outer jacket holding part. FIG. 2 is a perspective view showing a state that the coaxial connector is connected to the coaxial cable. FIG. 3A is a longitudinally sectional view of a part in which a holding part of the shield terminal is fixed to a terminal part of the coaxial cable. FIG. 3B is a sectional view taken along a line IIIb-IIIb of FIG. 3A. FIG. 4A is an enlarged view of a part shown by an arrow mark IVa in FIG. 3A. FIG. 4B is a view of a part shown by an arrow mark IVb in FIG. 4A.

As shown in FIG. 1A, the coaxial connector is attached to a terminal part of the coaxial cable 20 and includes a shield terminal 30, a central conductor 40 and a dielectric body 33 interposed between the shield terminal 30 and the central conductor 40.

As shown in FIG. 3A, the coaxial cable 20 includes a core wire 21, an insulator 22 for covering an outer periphery of the core wire 21, a braided part 23 for covering an outer periphery of the insulator 22 and an outer jacket 24 for covering an outer periphery of the braided part 23. The core wire 21, the insulator 22, the braided part 23 and the outer jacket 24 are arranged in order from a center to an outer side. Further, in a cable terminal part, a core wire exposing part 21A formed by removing the outer jacket 24, the braided part 23 and the insulator 22 to expose the core wire 21, an insulator exposing part 22A formed by removing the outer jacket 24 and the braided part 23 to expose the insulator 22 and a braided part exposing portion 23A formed by removing the outer jacket 24 to expose the braided part 23 are formed in order from an end side. To the core wire exposing part 21A of an end of the coaxial cable 20, a pin shaped central conductor (an inner terminal) 40 is attached.

On the other hand, as shown in FIG. 1A, the shield terminal 30 includes a terminal main body 31 and a holding part 32. The terminal main body 31 is formed substantially in a cylindrical shape with an electrically conductive material. The holding part 32 is provided continuously to one end side (a rear part) of the terminal main body 31. The holding part 32 and the terminal main body 31 are formed integrally by press working a thin metal plate having an electric conductivity. In the holding part 32, there are provided a braided part crimping member 36 which is crimped with the braided part exposing portion 23A formed in the terminal part of the coaxial cable 20 and an outer jacket holding member 37 located in a rear side thereof and held on a part of the coaxial cable 20 having the outer jacket 24.

The braided part crimping member 36 is a part which is crimped with the braided part exposing portion 23A of the coaxial cable 23 so as to enclose the braided part exposing part 23A from an outer side. As shown in FIG. 1B, the braided part crimping member 36 before a crimping operation is formed in the shape of U in section having a bottom plate 36*a* on which the braided part exposing portion 23A is mounted and a pair of braided part holding pieces 36*b* and 36*b* extending from both sides of the bottom plate 36*a* in a direction of width. Further, the outer jacket holding member 37 before a holding operation is formed in the shape of U in section including a bottom plate 37*a* on which the part having the outer jacket 24 is mounted and a pair of outer jacket holding pieces 37*b* and 37*b* extending form both sides of the bottom plate 37*a* in a direction of width. The bottom plate 36*a* of the braided part crimping member 36 and the bottom plate 37*a* of the outer jacket holding member 37, which have a slightly stepped part or inclined part, are gently continuous.

Further, in the shield terminal 30 of the present embodiment, as shown in FIG. 1 to FIG. 4, in a wall part of the braided part crimping member 36 which comes into direct contact with the braided part 23, that is, respectively in the bottom plate 36*a* and the braided part holding piece 36*b* of the one pair of braided part holding pieces 36*b* and 36*b* which is rounded inside and comes into direct contact with the braided part 23, round holes 38 are provided which a part of the braided part 23 enters when the braided part crimping member 36 is crimped with the braided part exposing portion 23A of the coaxial cable 20. In this case, the round holes 38 are circular through holes passing through in the direction of the thickness of the plate. The round hole 38 of the bottom plate 36*a* and the round hole 38 of the braided part holding piece 36*b* are arranged at positions where the round holes 38 sandwich the braided part exposing portion 23A between them under a state that the braided part crimping member 36 is crimped with the braided part exposing portion 23A of the coaxial cable 20 as shown in FIGS. 1A and 1B. In other words, the round hole 38 of the bottom plate 36*a* and the round hole 38 of the braided part holding piece 36*b* are disposed at positions which oppose each other in the state where the braided part crimping member 36 is crimped with the braided part exposing portion 23A. For example, a center axis of the round hole 38 of the bottom plate 36*a*, a center axis of the round hole 38 of the braided part holding piece 36*b* are identical each other, and they are identical to a straight line including a center of the coaxial cable 20 in a radial section of the coaxial cable 20.

A straight line connecting the round hole 38 of the bottom plate 36*a* and the round hole 38 of the braided part holding piece 36*b* is set so as to correspond to a direction that a fastening force is applied to the braided part exposing portion during the crimping operation. Here, the direction of the fastening force may be identical to a vertical direction, since the crimping operation is carried out by upper and lower molds. Further, on the bottom plate 37*a* of the outer jacket holding member 37, a round hole 39 having a similar purpose is provided.

The shield terminal 30 is attached to the coaxial cable 20 by crimping the braided part crimping member 36 with the braided part exposing portion 23A of the coaxial cable 20 and caulking the outer jacket holding member 37 on the part of the coaxial cable 20 having the outer jacket 24. In that case, when the braided part crimping member 36 is crimped with the braided part exposing portion 23A, a part of the braided part 23 enters the round holes 38 as shown in FIG. 3A to FIG. 4B. Especially, since not a square hole having corner parts which generate a regulating operation when the braided part 23 enters, but the round hole 38 having no corner parts is formed, the braided part 23 enters and bites the round hole 38 uniformly in an entire circumference. Accordingly, when the braided part 23 sufficiently enters the round hole 38, the fastening force is not especially increased during the crimping operation and a fixing force to the coaxial cable 20 can be increased without a fear of disconnection of the core wire 21.

Further, in the case of the shield terminal 30 of the present embodiment, since the round holes 38 which the braided part 23 enters are provided both in the bottom plate 36*a* and the braided part holding piece 36*b* of the braided part crimping member 36, the round holes 38 are arranged at the positions where the round holes 38 sandwich the braided part exposing portion 23A between them under a state that the braided part crimping member 36 is crimped with the braided part exposing portion 23A of the coaxial cable 20 and the direction in which the round hole 38 of the bottom plate 36*a* is connected to the round hole 38 of the braided part holding piece 36*b* is set so as to correspond to a direction that the fastening force is applied to the braided part exposing portion during the crimping operation, the braided part 23 can be assuredly allowed to enter both the round holes 38 during the crimping operation. Namely, since the round holes 38 are located at positions to which a pressing force is most strongly applied during the crimping operation, the braided part 23 assuredly enters the round holes 38. As a result, the fixing force of the shield terminal 30 to the braided part 23 can be increased.

The present invention is not limited to the above-described embodiment and may be suitably modified and improved. In addition thereto, the material, the form, the dimension, the number and the arranged position of each of components in the above-described embodiment may be arbitrarily set without a limitation as long as the present invention can be achieved.

Figure 5:
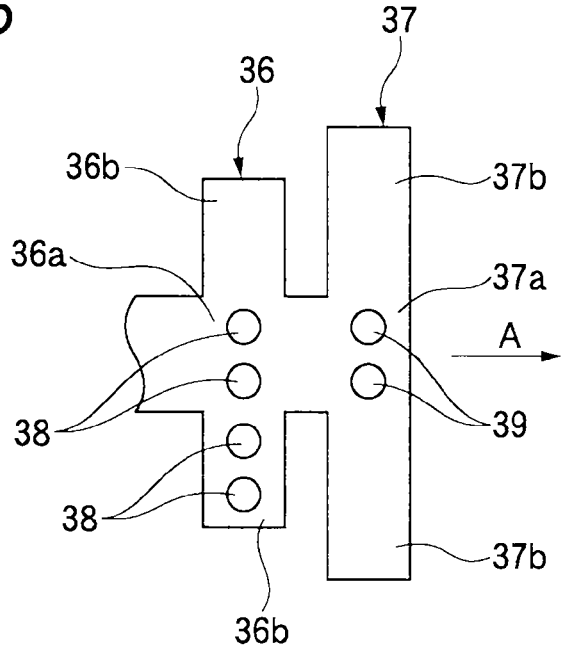
FIG. 5 is a development view of a braided part crimping member and an outer jacket holding part of a shield terminal of another embodiment of the present invention.
Figure 6:
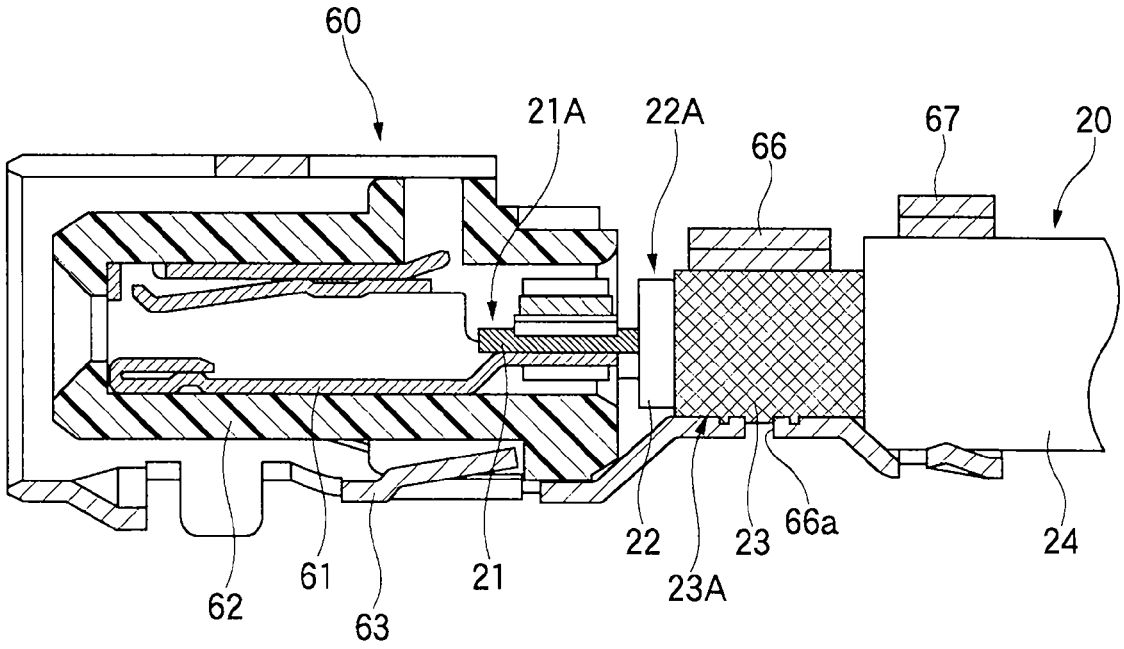
FIG. 6 is a sectional view showing a usual connecting structure of a coaxial connector and a coaxial cable.
Figure 7A:
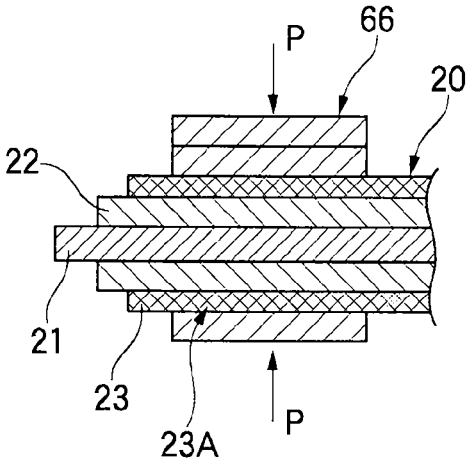
FIG. 7A is a sectional view showing a summary during a crimping operation of a braided part crimping member of a usual shield terminal.
Figure 7B:
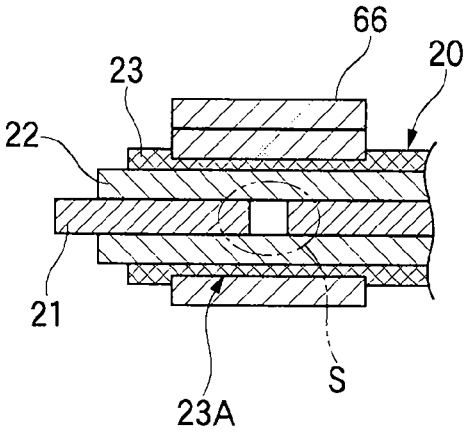
FIG. 7B is a sectional view showing a state that a disconnection is generated in a core wire due to a strong crimping operation.

For instance, in the above-described embodiment, an example is shown that the one round holes 38 are provided respectively in the bottom plate 36*a* and the one braided part holding piece 36*b* of the braided part crimping member 36, however, as shown in a development view of FIG. 5 of the rear part of the shield terminal, a plurality of round holes 38 may be arranged in a direction orthogonal to the longitudinal direction of the coaxial cable.

As described in the embodiment, when the one round holes 38 are merely provided respectively in the bottom plate 36*a* or the braided part holding piece 36*b* of the braided part crimping member 36, a diameter of the round hole 38 needs to be enlarged in order to increase an effective edge length of the round hole 38. Here, the effective edge of the round hole 38 indicates a length of a peripheral edge part of the round hole 38 which contributes to exhibit an effective resistance force when a tensile force A is applied along the longitudinal direction of the coaxial cable. However, as shown in the example of FIG. 5, when the plurality of round holes 38 are arranged in the direction orthogonal to the longitudinal direction of the coaxial cable, the effective edge length to the tensile force A can be long ensured by decreasing the diameter of the round hole 38. Accordingly, the resistance force (the fixing force) strong to the tension can be exhibited.

The present application is based on Japanese Patent Application No. 2011-084595 filed on Apr. 6, 2011, the contents of which are incorporated herein by way of reference.

INDUSTRIAL APPLICABILITY

The present invention is useful to provide a shield terminal for a coaxial cable which can increase a fixing force of a braided part crimping member to a braided part without especially increasing a fastening force during a crimping operation.

REFERENCE SIGNS LIST

20 coaxial cable
21 core wire
22 insulator
23 braided part
23A braided part exposing portion
24 outer jacket
30 shield terminal
36 braided part crimping member
36*a* bottom plate
36*b* braided part holding piece
38 round hole

The invention claimed is:

1. A shield terminal, configured to be connected to a coaxial cable including a core wire, an insulator covering an outer periphery of the core wire, a braided part covering an outer periphery of the insulator and an outer jacket covering an outer periphery of the braided part, the shield terminal comprising:

a braided part crimping member configured to be crimped with and enclose a braided part exposing portion which is formed by removing the outer jacket to expose the braided part, wherein a wall part of the braided part crimping member which comes into direct contact with the braided part is formed with at least two first circular round holes and at least two second circular round holes so that a part of the braided part enters the first circular round holes and the second circular round holes in a state where the braided part crimping part is crimped with the braided part exposing portion, wherein the first circular round holes and the second circular round holes are configured to bite the braided part uniformly around respective circumferences of the first circular round holes and the second circular round holes, wherein the braided part crimping member includes a bottom plate on which the braided part is mounted and a pair of braided part holding pieces extending from both sides of the bottom plate in a direction of width, the first circular round holes are formed in the bottom plate, and the second circular round holes are formed in one of the braided part holding pieces, and wherein in an assembled state a straight line connects at least one of the first circular round holes and at least one of the second circular round holes, wherein the at least one of the first circular round holes and the at least one of the second circular round holes are configured to receive a fastening force during crimping along the straight line.

2. The shield terminal as set forth in claim 1, wherein the first circular round holes and the second circular round holes are arranged in a direction orthogonal to a longitudinal direction of the coaxial cable.

3. The shield terminal as set forth in claim 2, wherein the first circular round holes and the second circular round holes are disposed at positions which oppose each other in the state where the braided part crimping member is crimped with the braided part exposing portion.

4. The shield terminal as set forth in claim 1, wherein the braided part crimping member comprises the bottom plate and the pair of braided part holding pieces so as to have a U-shape in section, one of the braided part holding pieces which is rounded inside and comes into direct contact with the braided part is formed with the second circular round holes, the first circular round holes and the second circular round holes are arranged at positions so as to sandwich the braided part exposing portion therebetween in the state where the braided part crimping part is crimped with the braided part exposing portion.

5. The shield terminal as set forth in claim 4, wherein the first circular round holes and the second circular round holes are arranged in a direction orthogonal to a longitudinal direction of the coaxial cable.

* * * * *